United States Patent [19]

Sung

[11] Patent Number: 4,504,278

[45] Date of Patent: Mar. 12, 1985

[54] CORROSION INHIBITED MOTOR FUEL

[75] Inventor: Rodney L. Sung, Fishkill, N.Y.

[73] Assignee: Texaco Inc., White Plains, N.Y.

[21] Appl. No.: 625,167

[22] Filed: Jun. 27, 1984

[51] Int. Cl.[3] ..... C10L 1/22

[52] U.S. Cl. ..... 44/53; 44/56; 252/392; 564/50; 564/163; 564/123

[58] Field of Search ..... 44/53, 56, 63, 72; 252/392; 564/50, 163, 123

[56] References Cited

U.S. PATENT DOCUMENTS 3,409,668 11/1968 Palazzo et al. ..... 564/164
3,780,089 12/1973 Widdig et al. ..... 564/50
4,282,008 8/1981 Sung ..... 44/56

OTHER PUBLICATIONS

Edited by Jacob Zabicky, " The Chemistry of Amides", 1970, pp. 94 and 95.

*Primary Examiner*—Y. Harris-Smith
*Attorney, Agent, or Firm*—Robert A. Kulason; James J. O'Loughlin; Carl G. Seutter

[57] ABSTRACT

A novel fuel composition contains ethanol or methanol plus, as a corrosion inhibitor, a reaction product of a secondary amine, an isatoic anhydride and a ($C_{10}$–$C_{14}$ alkoxy)-n-alkyl primary amine.

26 Claims, No Drawings

CORROSION INHIBITED MOTOR FUEL

FIELD OF THE INVENTION

This invention relates to a fuel composition for internal combustion engines particularly characterized by corrosion inhibition.

BACKGROUND OF THE INVENTION

As is well known to those skilled in the art, fuel compositions typified by gasohol and alcohols must possess low corrosion activity; and this may be effected by addition thereto of various corrosion inhibition systems. It is an object of this invention to provide a fuel composition for internal combustion engines particularly characterized by corrosion inhibition. Other objects will be apparent to those skilled in the art.

STATEMENT OF THE INVENTION

In accordance with certain of its aspects, the fuel composition of this invention may comprise (a) a major portion of a fuel containing (i) at least one alcohol selected from the group consisting of ethanol and methanol and (ii) gasoline in amount of 0–50 volumes per volume of alcohol; and (b) a minor corrosion inhibition amount of, as a corrosion inhibiting agent, the reaction product of isatoic anhydride and di-hydrocarbyl secondary amine with a hydrocarbonoxy, hydrocarbyl primary amine.

DESCRIPTION OF THE INVENTION

The fuel for internal combustion engines which may be treated by the process of this invention may contain (i) at least one alcohol selected from the group consisting of ethanol and methanol and (ii) gasoline in amount of 0–50 volumes per volume of alcohol. The fuel may be an alcohol-type fuel containing little or no hydrocarbon. Typical of such fuels are methanol, ethanol, mixture or methanol-ethanol, etc. Commercially available mixtures may be employed. Illustrative of such commercially available mixtures may be that having the following typical analysis:

TABLE

| Components | Parts |
|---|---|
| ethanol | 3157.2 |
| methy isobutyl ketone | 126.3 |
| acetic acid | 0.256 |
| methyl alcohol | 0.24 |
| isopropyl alcohol | 0.2 |
| n-propyl alcohol | 0.162 |
| ethyl acetate | 0.2 |

The fuels which may be treated by the process of this invention include gasohols which may be formed by mixing 90–95 volumes of gasoline with 5–10 volumes of ethanol or methanol. A typical gasohol may contain 90 volumes of gasoline and 10 volumes of absolute ethyl alcohol.

It is preferred that the fuels to be treated by the process of this invention be substantially anhydrous i.e. that they contain less than about 0.3 v% water; typically they may contain 0.001 v%–0.005 v%, say about 0.004 v% water.

It is a feature of these fuels that they may undesirably contain acidic contaminants which may cause serious corrosion problems. These contaminants are particularly in evidence when the alcohol is a commercially available alcohol which contains therein inter alia acids concurrently produced as by fermentation processes for producing ethanol or acids which may have been picked up during handling. Acetic acid is a common acid present in the commercially available alcohols produced by fermentation; and it may be present in amount of 0.003 w%–0.008 w% of the total of the alcohol.

In accordance with practice of the process of this invention, there may be added to the fuel a minor corrosion inhibiting amount of, as a corrosion inhibiting agent, the reaction product of isatoic anhydride and di-hydrocarbyl secondary amine with a hydrocarbonoxy, hydrocarbyl primary amine.

The isatoic anhydride which may be employed in practice of the process of this invention may be characterized by the formula:

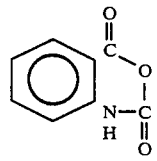

This charge material may bear inert substitutents (which do not intefere with the reaction) on the nitrogen atom or on the ring. Typical of these may be alkyl, aralkyl, alkaryl, aryl, or cycloalkyl hydrocarbon substituents. The ring may also bear other inert substituents typified by alkoxy, aryloxy, etc.

The preferred isatoic anhydride is isatoic anhydride itself.

The di-hydrocarbyl secondary amine which may be employed in practice of the first step of the process of this invention may be characterized by the formula $R_2NH$. Each R group in these dihydrocarbyl amines may contain aliphatic or aromatic moieties—including alkyl, alkaryl, aralkyl, aryl, or cycloalkyl hydrocarbons. The R groups may be different although they are preferably the same. They may bear inert substituents. Preferably the R group contains 12–18, preferably 12–14, carbon atoms; and most preferably it may be a $C_{12}$–$C_{18}$ n-alkyl group such as cocoyl $C_{12}$. Di-cocoyl amine is the preferred secondary amine. Other secondary amines which may be employed may include:

TABLE

| |
|---|
| Di-tallow amine |
| Di-soya amine |
| Di-stearyl amine |
| Di-hexadecyl amine |
| Di-octadecyl amine |

It will be apparent to those skilled in the art that the several reactants may bear inert substituents which are typified by alkyl, alkoxy, etc. It will also be apparent that the preferred compounds to be employed will be those which are soluble in the solvents employed during the reaction and which produce products which are soluble in or compatible with the system in which the product is to be employed.

Typical polar solvents which may be employed may include dimethyl formamide, tetrahydrofuran, dimethyl sulfoxide. A particularly preferred system may include dimethyl formamide.

The first step in the formation of the desired additive in the preferred embodiment may preferably be effected by placing substantially equimolar quantities of the isatoic anhydride and the secondary amine in a reaction vessel in an excess of solvent. A typical solvent (eg dimethyl formamide) may be present in the amount of 30–100 volumes, say 70 volumes per 100 volumes of the total of the other reactants. It is not necessary to add catalyst. The reaction mixture may be refluxed at 145° C.–155° C., say 153° C. for 8–24 hours, say 8 hours.

At the end of the reaction period, the reaction mixture may be cooled to ambient temperature of 20° C.–27° C., say 25° C. and filtered and then stripped (as by distillation at 80° C.–100° C., say 120° C.) of solvent.

The residue which is generally a waxy solid or viscous liquid is recovered in yield approaching stoichiometric.

Although the reaction product of the isatoic anhydride and the secondary amine (di-hydrocarbon amine) so prepared may be found to possess activity as a rust and corrosion inhibitor, it is preferred to convert it into a salt thereof.

In the preferred embodiment, the product so prepared is not isolated, but is reacted further with a substantially equimolar amount of a hydrocarbonoxy, hydrocarbyl primary amine $R'OR''NH_2$.

In the above compound, R′ may be a hydrocarbon group selected from the group consisting of alkyl, aralkyl, cycloalkyl, aryl, and alkaryl, including such radicals when inertly substituted. When R′ is alkyl, it may typically be methyl, ethyl, n-propyl, iso-propyl, n-butyl, i-butyl, sec-butyl, amyl, octyl, decyl, octadecyl, etc. When R′ is aralkyl, it may typically be benzyl, beta-phenylethyl, etc. When R′ is cycloalkyl, it may typically be cyclohexyl, cycloheptyl, cyclooctyl, 2-methylcyclo-heptyl, 3-butylcyclohexyl, 3-methylcyclohexyl, etc. When R′ is aryl, it may typically be phenyl, naphthyl, etc. When R′ is aryl, it may typically be phenyl, naphthyl, etc. When R′ is alkaryl it may typically be tolyl, xylyl, etc. R′ may be inertly substituted i.e. it may bear a non-reactive substituent such as alkyl, aryl, cyloalkyl, ether, etc. Typically inertly substituted R′ groups may include 2-ethoxyethyl, carboethoxymethyl, 4-methylcyclohexyl, etc. The preferred R′ groups may be $C_{10}$–$C_{14}$ alkyl groups.

R″ may be selected from the same group as that from which R′ is selected subject to the proviso that R″ contain two valence bonds—alkylene, alkarylene, aralkylene, cycloalkylene, arylene, etc. Preferably R″ is an alkylene hydrocarbon group containing 1–8, preferably 2–6, say 3 carbon atoms.

Illustrative compounds may include those in the following table, the first listed being preferred:

TABLE

| |
|---|
| $C_{13}H_{27}O(CH_2)_3NH_2$ |
| $C_{10}H_{21}O(CH_2)_3NH_2$ |
| $C_{11}H_{23}O(CH_2)_3NH_2$ |
| $C_{12}H_{25}O(CH_2)_3NH_2$ |
| $C_{14}H_{29}O(CH_2)_3NH_2$ |
| $C_{15}H_{31}O(CH_2)_3NH_2$ |

Practice of the second step of the process of this invention may be carried out by adding the primary amine to the stripped reaction mixture (preferably in equimolar proportions) at ambient temperature of 25° C.–35° C., say 25° C. and stirring for 30–90 minutes, say 60 minutes. The salt so formed may be analyzed by IR and NMR.

Typical of the products so prepared may be those noted in the following table:

TABLE

I. The product formed by reacting equimolar amounts of the reaction product of isatoic anhydride and di-($C_{12}$–$C_{18}$ hydrocarbonyl) amine with n-$C_{12}H_{25}O(CH_2)_3NH_2$.

II. The product formed by reacting equimolar amounts of the reaction product of di-tallow amine and isatoic anhydride with n-$C_{12}H_{25}O(CH_2)_3NH_2$.

III. The product formed by reacting equimolar amounts of the reaction product di-stearyl amine and isatoic anhydride with n-$C_{12}H_{25}O(CH_2)_3NH_2$.

IV. The product formed by reacting equimolar amounts of the reaction product of di-($C_{12}$–$C_{15}$) amine and isatoic anhydride with n-$C_{13}H_{27}O(CH_2)_3NH_2$.

V. The product formed by reacting equimolar amounts of the reaction product of di-($C_{12}$–$C_{25}$) amine and isatoic anhydride with n-$C_{14}H_{29}O(CH_2)_3NH_2$.

The so-prepared rust and corrosion inhibitor may be added to fuels (including alcohol, gasohol etc.) or to antifreeze. These compositions may be particularly found to be effective as rust and corrosion inhibitors when added to absolute alcohol fuels typified by those available commercially containing components including ethers, esters, acids, etc.

The so-prepared rust and corrosion inhibitors may be added to a fuel in amount of 0.25–25 PTB, preferably 1–20 PTB, more preferably 1–10 PTB, say 10 PTB. (PTB stands for pounds of additive per thousand barrels of fuel). Alternatively expressed, the inhibitor may be added to a fuel in minor corrosion-inhibiting amount of 0.001–0.1 w%, preferably 0.004–0.008 w%, more preferably 0.004–0.04 w%, say 0.04 w%. Larger amounts may be employed but may not be necessary.

It is a feature of this invention that the fuel composition so prepared is characterized by its increased corrosion and rust inhibition i.e. its decreased ability to form rust on iron surfaces in the presence of aqueous acid systems.

The corrosive nature of the formulated products may be readily measured by the Iron Strip Corrosion Test (ISCT). In this test, an iron strip (12 mm×1 mm) is prepared by washing in dilute aqueous hydrochloric acid to remove mill scale, then with distilled water to remove the acid, then with acetone-followed by air drying. The strip is then polished with #100 emery cloth.

The polished strip is totally immersed in 110 ml of the test liquid in a 4 ounce bottle for 15 minutes at room temperature of 20° C. 20 ml of the test liquid is poured off and replaced with 20 ml of distilled water. The bottle is shaken as the sample is maintained for 3 hours at 90° F. The percent rust on the strip is determined visually. A second reading is taken after 40 hours.

The inhibited fuels of this invention, after 40 hours of ISCT generally show a Rust and Corrosion rating below about 2–3% and frequently as low as trace-to-1%.

DESCRIPTION OF PREFERRED EMBODIMENTS

Practice of this invention will be apparent to those skilled in the art from the following examples wherein, as elsewhere in this specification, all parts are parts by weight unless otherwise specified.

EXAMPLE I

In this example which illustrates the best mode known of preparing the product of this invention, 20 parts of isatoic anhydride, 100 parts of dimethylformamide DMF, and 51 parts of Armeen 2C brand of dicocoyl amine may be refluxed in a reaction vessel for 8 hours. The mixture is then filtered and stripped of DMF by heating to 120° F. for 2 hours. In this embodiment, the intermediate product is not separated but is reacted further by stirring for 1 hour at 25° C. with 32 parts of Armeen EA-13 brand of $C_{12}H_{25}O—(CH_2)_3NH_2$. Analysis is by IR and NMR.

EXAMPLE II

The additive product prepared in Example I (384 ppm corresponding to 100 PTB) is added to 90 parts of the anhydrous alcohol composition of Table I and 10 parts of distilled water and the resulting composition was tested in the ISCT to determine the Rust and Corrosion rating after 6 days.

EXAMPLE III*

The procedure of Examples I–II was duplicated except that no additive was present—only 10 parts of distilled water.

EXAMPLE IV*

The product of Example II was duplicated except that the additive was 19.6 parts (76 ppm) of a commercial rust and corrosion inhibitor.

The results of the Iron Strip Corrosion Test were as follows:

TABLE

| Example | 6 day Rust & Corrosion Rating |
|---|---|
| II | 0 |
| III* | 100% |
| IV* | 100% |

From the above table, it will be apparent that the system of Example II, prepared in accordance with practice of the process of this invention, showed no rust and corrosion. Control Examples III*–IV* showed 100% rust and corrosion which is unsatisfactory.

TABLE

| Example | Secondary Amine |
|---|---|
| VII | Di-tallow amine |
| VIII | di-stearyl amine |
| IX | di-soya amine |

Results comparable to those of Example II may be obtained when the isatoic anhydride reactant is:

TABLE

| Example | Reactant |
|---|---|
| X | 3-methyl isatoic anhydride |
| XI | 3-ethyl isatoic anhydride |
| XII | 3-propyl isatoic anhydride |
| XIII | 3-butyl isatoic anhydride |

Results comparable to those of Example II may be obtained when the alkoxy-amine reactant is:

TABLE

| Example | Alkoxy-amine |
|---|---|
| XIV | $C_{10}H_{21}O(CH_2)_3NH_2$ |

TABLE-continued

| Example | Alkoxy-amine |
|---|---|
| XV | $C_{12}H_{25}O(CH_2)_3NH_2$ |
| XVI | $C_{14}H_{29}O(CH_2)_3NH_2$ |

Results comparable to those of Example I may be obtained if the fuel is as follows:

TABLE

| Example | Fuel |
|---|---|
| XVII | Gasohol containing 90 v % gasoline and 10 v % absolute ethanol |
| XVIII | absolute ethanol |
| XIX | absolute methanol |

Although this invention has been illustrated by reference to specific embodiments, it will be apparent to those skilled in the art that various changes and modifications may be made which clearly fall within the scope of this invention.

What is claimed is:

1. A fuel composition for internal combustion engines comprising (a) a major portion of fuel containing (i) at least one alcohol selected from the group consisting of ethanol and methanol and (ii) gasoline in amount of 0–50 volumes per volume of alcohol; and (b) a minor corrosion inhibition amount of, as a corrosion inhibiting agent, the reaction product in polar solvent of (i) isatoic anhydride and (ii) di-hydrocarbyl secondary amine with (iii) a hydrocarbonoxy, hydrocarbyl primary amine further reacted at ambient temperature.

2. A fuel composition for internal combustion engines as claimed in claim 1 wherein said fuel is an alcohol.

3. A fuel composition for internal combustion engines as claimed in claim 1 wherein said fuel is methanol.

4. A fuel composition for internal combustion engines as claimed in claim 1 wherein said fuel is ethanol.

5. A fuel composition for internal combustion engines as claimed in claim 1 wherein said fuel is a commercial ethanol.

6. A fuel composition for internal combustion engines as claimed in claim 1 wherein said fuel is a commercial ethanol containing acid.

7. A fuel composition for internal combustion engines as claimed in claim 1 wherein said fuel is a commercial ethanol containing acetic acid.

8. A fuel composition for internal combustion engines as claimed in claim 1 wherein said fuel is a gasohol.

9. A fuel composition for internal combustion engines as claimed in claim 1 wherein said fuel is substantially anhydrous.

10. A fuel composition for internal combustion engines as claimed in claim 1 wherein said fuel contains less than 0.3 v% water.

11. A fuel composition for internal combustion engines as claimed in claim 1 wherein said primary amine is $R'OR''NH_2$ wherein R′ is alkyl, alkaryl, aralkyl, cycloalkyl, or aryl hydrocarbon and R″ is alkylene, alkarylene, aralkylene, cycloalkylene, or arylene hydrocarbon.

12. A fuel composition for internal combustion engines as claimed in claim 1 wherein said R′ contains 10–14 carbon atoms.

13. A fuel composition for internal combustion engines as claimed in claim 1 wherein said R″ is propylene.

14. A fuel composition for internal combustion engines as claimed in claim 1 wherein said primary amine is ($C_{10}$–$C_{14}$ alkoxy)propyl amine.

15. A fuel composition for internal combustion engines as claimed in claim 1 wherein said primary amine is $C_{12}H_{25}O—CH_2CH_2CH_2NH_2$.

16. A fuel composition for internal combustion engines as claimed in claim 1 wherein said $R_2NH$, and R is alkyl, alkaryl, alkaryl, cycloalkyl, or aryl hydrocarbon.

17. A fuel composition for internal combustion engines as claimed in claim 1 wherein said secondary amine is di-cocoyl amine.

18. A fuel composition for internal combustion engines as claimed in claim 1 wherein said corrosion inhibiting agent is present in minor corrosion inhibiting amount of 0.001 w%–0.05 w% of said fuel composition.

19. A fuel composition for internal combustion engines comprising (a) a major portion of a fuel containing absolute ethanol; and (b) a minor corrosion inhibiting amount, 0.001 w%–0.05 w% of said fuel composition, of as a corrosion inhibiting agent the product formed by reacting the reaction product in polar solvent of (i) isatoic anhydride and (ii) $C_{12}H_{25}O(CH_2)_3NH_2$ further reacted at ambient temperature with (iii) dicocoyl amine.

20. A composition comprising the product formed by reacting the reaction product in polar solvent of (i) isatoic anhydride and (ii) a dihydrocarbyl secondary amine further reacted at ambient temperature with (iii) a hydrocarbonoxy, hydrocarbyl primary amine.

21. A composition comprising the product formed by reacting the reaction product of isatoic anhydride and $R_2NH$ with $R'OR''NH_2$ wherein R and R′ are alkyl, alkaryl, aralkyl, cycloalkyl, or aryl hydrocarbon groups and R″ is an alkylene, aralkylene, alkarylene, cycloalkylene, or arylene hydrocarbon group.

22. A composition as claimed in claim 21 wherein R is a $C_{12}$–$C_{18}$ alkyl hydrocarbon group.

23. A composition as claimed in claim 21 wherein R is cocoyl.

24. A composition as claimed in claim 21 wherein R′ is a $C_{10}$–$C_{14}$ alkyl hydrocarbon group.

25. A composition as claimed in claim 21 wherein R″ is a $C_1$–$C_6$ alkylene hydrocarbon group.

26. The method which comprises reacting in polar solvent isatoic anhydride and dihydrocarbyl secondary amine thereby forming reaction product of isatoic anhydride and dihydrocarbyl secondary amine; and reacting at ambient temperature a hydrocarbonoxy, hydrocarbyl primary amine with said reaction product.

* * * * *

UNITED STATES PATENT AND TRADEMARK OFFICE

CERTIFICATE OF CORRECTION

PATENT NO. : 4,504,278

DATED : 12 March 1985

INVENTOR(S) : RODNEY L. SUNG

It is certified that error appears in the above-identified patent and that said Letters Patent is hereby corrected as shown below:

Claim 1 should read as follows:

A fuel composition for internal combustion engines comprising (a) a major portion of fuel containing (i) at least one alcohol selected from the group consisting of ethanol and methanol and (ii) gasoline in amount of 0-50 volumes per volume of alcohol; and (b) a minor corrosion inhibition amount of, as a corrosion inhibiting agent, the reaction product in polar solvent of (i) isatoic anhydride and (ii) di-hydrocarbyl secondary amine further reacted at ambient temperature with (iii) a hydrocarbonoxy, hydrocarbyl primary amine.

Claim 16, line 2, after "said" insert -- dihydrocarbyl secondary amine is --

Signed and Sealed this

*First* Day of *October 1985*

[SEAL]

*Attest:*

*Attesting Officer*

DONALD J. QUIGG

*Commissioner of Patents and Trademarks—Designate*